US011091353B2

(12) United States Patent
Zapf

(10) Patent No.: US 11,091,353 B2
(45) Date of Patent: Aug. 17, 2021

(54) BELT ROLLER FOR AN ELEVATOR SYSTEM

(71) Applicant: Inventio AG, Hergiswil (CH)

(72) Inventor: Volker Zapf, Obernau (CH)

(73) Assignee: INVENTIO AG, Hergiswil NW (CH)

( * ) Notice: Subject to any disclaimer, the term of this patent is extended or adjusted under 35 U.S.C. 154(b) by 693 days.

(21) Appl. No.: 15/754,001

(22) PCT Filed: Aug. 18, 2016

(86) PCT No.: PCT/EP2016/069561
§ 371 (c)(1),
(2) Date: Feb. 21, 2018

(87) PCT Pub. No.: WO2017/032675
PCT Pub. Date: Mar. 2, 2017

(65) Prior Publication Data
US 2018/0244499 A1 Aug. 30, 2018

(30) Foreign Application Priority Data
Aug. 21, 2015 (EP) ..... 15182046

(51) Int. Cl.
*B66B 15/04* (2006.01)
*B66B 7/06* (2006.01)
*B66B 9/00* (2006.01)
*B66B 15/02* (2006.01)

(52) U.S. Cl.
CPC ..... *B66B 15/04* (2013.01); *B66B 7/062* (2013.01); *B66B 9/00* (2013.01); *B66B 15/02* (2013.01)

(58) Field of Classification Search
CPC ..... B66B 15/04; B66B 7/062; B66B 15/02
See application file for complete search history.

(56) References Cited

U.S. PATENT DOCUMENTS 8,789,658 B2 * 7/2014 Goser ..... B66B 7/062 187/255
2016/0060077 A1 * 3/2016 Haapaniemi ..... B66B 11/08 187/255

FOREIGN PATENT DOCUMENTS

DE 102005030255 A1 1/2007
DE 102008037537 A1 5/2010
EP 0346160 A1 12/1989
EP 0509404 A2 10/1992
EP 1777189 A1 4/2007
EP 3305707 A1 * 4/2018 ..... B66B 7/062
JP 2002206624 A * 7/2002

* cited by examiner

*Primary Examiner* — Diem M Tran
(74) *Attorney, Agent, or Firm* — William J. Clemens; Shumaker, Loop & Kendrick, LLP

(57) ABSTRACT

In an elevator system, a belt-type carrier is guided over a pulley. In this case, longitudinal elevations of the belt-type carrier engage into longitudinal recesses on a roller contact surface. The roller has at least one retaining element, which is arranged laterally to the contact surface. In this case, a distance between an outermost longitudinal recess and the retaining element is less than half a longitudinal recess width of the roller contact surface.

16 Claims, 3 Drawing Sheets

BELT ROLLER FOR AN ELEVATOR SYSTEM

FIELD

The present invention relates to an elevator system and in particular a design of a roller in this elevator system.

BACKGROUND

In elevator systems, steel cables are traditionally used as carrier means for carrying and/or driving an elevator car. According to a further development of such steel cables, belt-type carrier means are used that have tension members and a sheathing arranged around the tension members. Such belt-type carrier means, similar to conventional steel cables, are guided over drive pulleys and deflection rollers in the elevator system. However, in contrast to steel cables, belt-type carrier means are not guided in grooves in the deflection rollers and driving disks, but instead, the belt-type carrier means essentially lie on top of the deflection rollers and drive pulleys.

Carrier means in elevator systems do not always run precisely perpendicular to an axis of deflection rollers or drive pulleys. An occurrence of diagonal pull can be due to a design, on the one hand, or be caused by imprecise mounting of the elevator system, on the other. As a result of such a diagonal pull of the carrier means, there is a danger of the carrier means laterally derailing from a deflection roller or a drive pulley of the drive. In order to prevent this, attempts are made to guide the belt-type carrier means laterally on deflection rollers or drive pulleys. For example, crowned deflection rollers are used, on which this type of carrier means are laterally guided to a certain degree. In order to prevent the lateral derailment of the belt-type carrier means, raised lateral edges are used on the deflection rollers or drive pulleys. In addition, belt-type carrier means are also known that have longitudinal ribs and longitudinal grooves on the traction surface of the carrier means, as well as on the traction surface of the deflection rollers or drive pulleys, and that engage into each other, thereby ensuring a lateral guidance of the belt-type carrier means on the deflection rollers or drive pulleys.

It has been shown, however, that measures such as crowned deflection rollers and drive pulleys, raised lateral edges or longitudinal flutes in the carrier means do not prevent lateral derailment in every case. It has been observed in particular in the case of carrier means having longitudinal ribs that the carrier means are laterally displaced one or more longitudinal ribs by a diagonal pull so that the carrier means projects laterally beyond the deflection rollers without being fully laterally derailed. There is thus the danger that a carrier means is at least partly laterally derailed from a deflection roller or a drive pulley without this being detected by the safety system of the elevator system.

SUMMARY

It is therefore an object of the present invention to provide an elevator device in which some lateral slipping of the rollers is reliably prevented. Such a device should also be cost-effective in manufacture and robust in use.

The object is achieved by an elevator system, in which a belt-type carrier means is guided over rollers, wherein longitudinal elevations of the belt-type carrier means engage into longitudinal recesses of a roller contact surface, and wherein the roller has at least one retaining element. The retaining element is arranged laterally to the roller contact surface and a distance between an outermost longitudinal recess and the retaining element is less than half a longitudinal recess width of the roller contact surface.

A roller designed in such a manner first offers the advantage that it makes a lateral derailment of the belt-type carrier means very difficult or prevents it altogether. In order to ensure the most economical and safe operation of the elevator system, it is therefore important that the belt-type carrier means is not damaged by a lateral displacement away from the roller contact surface. It can be ensured through provision of a retaining element close to the outermost longitudinal recess that a derailing carrier means is guided back by the retaining element before it can be laterally displaced. It has been observed that such belt-type carrier means having longitudinal recesses have the tendency, in the case of a diagonal pull, to move up in the longitudinal recesses of the roller contact surface and possibly jump into the next longitudinal recess of the roller contact surface. Then, by keeping the distance between the outermost longitudinal recess and the retaining element to less than half the width of a longitudinal recess, the derailing belt-type carrier means is guided back into the correct position by the retaining element before the belt-type carrier means can completely come up out of the longitudinal recess of the roller contact surface.

In one exemplary embodiment, the distance between the outermost longitudinal recess and the retaining element is less than 80% or less than 60% or less than 40% or less than 20% of half of the longitudinal recess width of the roller contact surface. On the one hand, the distance is kept as narrow as possible so that the belt-type carrier means can rise up as little as possible in the longitudinal recess of the roller contact surface before it is guided back into the longitudinal recess by the retaining element. On the other hand, however, this distance should not be designed too narrow, so that the belt-type carrier means does not incur damage from the retaining element during normal operation. An ideal distance can thus be selected depending upon the design of the belt-type carrier means. It is essential that the distance be less than half the width of a longitudinal recess so that the belt-type carrier means can definitely be prevented from climbing completely out of the longitudinal recess.

In one exemplary embodiment, a carrier means height is essentially equally as large as the retaining element. Such a dimensioning of the retaining element ensures that the laterally rising belt-type carrier means cannot project beyond the retaining element.

In one exemplary embodiment, an edge of the retaining element that is exposed in the direction of the roller contact surface has a round design. This has the advantage that the laterally derailing belt-type carrier means cannot incur damage from a sharp edge. The belt-type carrier means is guided back into its original position on the rollers as smoothly as possible by the retaining element.

In one exemplary embodiment, the retaining element has a guide surface that is inclined by an angle relative to a line perpendicular to the axis of rotation of the roller. In one exemplary embodiment, the guide surface is angled more toward the belt-type carrier means as the guide surface gets farther from the axis of rotation. In other words, the guide surface of the retaining element thus has an undercut so that the guide surface leans over the belt-type carrier means. This has the advantage that the belt-type carrier means as a result only tangentially contacts the retaining element when there is a lateral displacement, whereby the belt-type carrier means is more smoothly guided back into its intended position on the roller. In addition, the inclination of the guide surface causes the belt-type carrier means to be guided downward into the longitudinal recess of the roller contact surface, which facilitates the belt-type carrier means being guided back into the intended position.

In one advantageous refinement, the angle of the guide surface is between 0° and 15° or between 1° and 10° or between 2° and 8° or between 3° and 7°. Depending upon the design of the belt-type carrier means and the distance between the outermost longitudinal recess of the roller and the retaining element, an optimal inclination of the guide surface can be chosen here.

In one advantageous embodiment, one retaining element is arranged on each side of the roller contact surface. This has the advantage that a lateral derailment can thereby be effectively prevented on both sides of the roller.

In one exemplary embodiment, the roller is a drive roller and the roller contact surface is a traction surface.

In an alternative embodiment, the roller is a car deflection roller or a counterweight deflection roller.

In an additional alternative embodiment, the roller is a different deflection roller in an elevator system.

Of course, a plurality of the roller types mentioned can be mounted in an elevator system having a retaining element described here. Depending upon the design of the elevator system, diagonal pulls can be expected on different rollers of an elevator system. It can therefore be advantageous, depending upon the elevator system, to equip one or more rollers with the retaining elements described here.

In one exemplary embodiment, the longitudinal elevations of the belt-type carrier means are designed as V-ribs and the longitudinal recesses are designed as V-shaped grooves.

In one alternative embodiment, the longitudinal elevations of the belt-type carrier means are designed as elevations having a semi-circular cross-section and the longitudinal recesses of the roller contact surface are designed as recesses having a semi-circular cross-section.

The retaining elements described here can basically be used for different types of belt-type carrier means having longitudinal elevations. In addition to the aforementioned V-rib belts and connecting lines having individually sheathed cables that are connected together via a common backing layer, a whole array of additional belt-type carrier means can obviously be used.

In one exemplary embodiment, a number of longitudinal elevations of the belt-type carrier means is the same as a number of longitudinal recesses of the roller contact surface. This has the advantage that a lateral jumping of the belt-type carrier means in the longitudinal recess of the roller contact surface is not permitted at all. As soon as the belt-type carrier means in this embodiment climbs up one side in a longitudinal recess, it comes into contact with the guide surface of the retaining element before it can laterally displace. Lateral displacers of the belt-type carrier means can thus be completely suppressed, which is advantageous for an economical and safe operation of the elevator system.

In one exemplary embodiment, the roller and the retaining element are designed as one piece. This has the advantage that the retaining element remains fixed in its intended position.

DESCRIPTION OF THE DRAWINGS

The invention is explained in detail symbolically and by way of example in reference to figures. Shown are.

DETAILED DESCRIPTION

Figure 1:
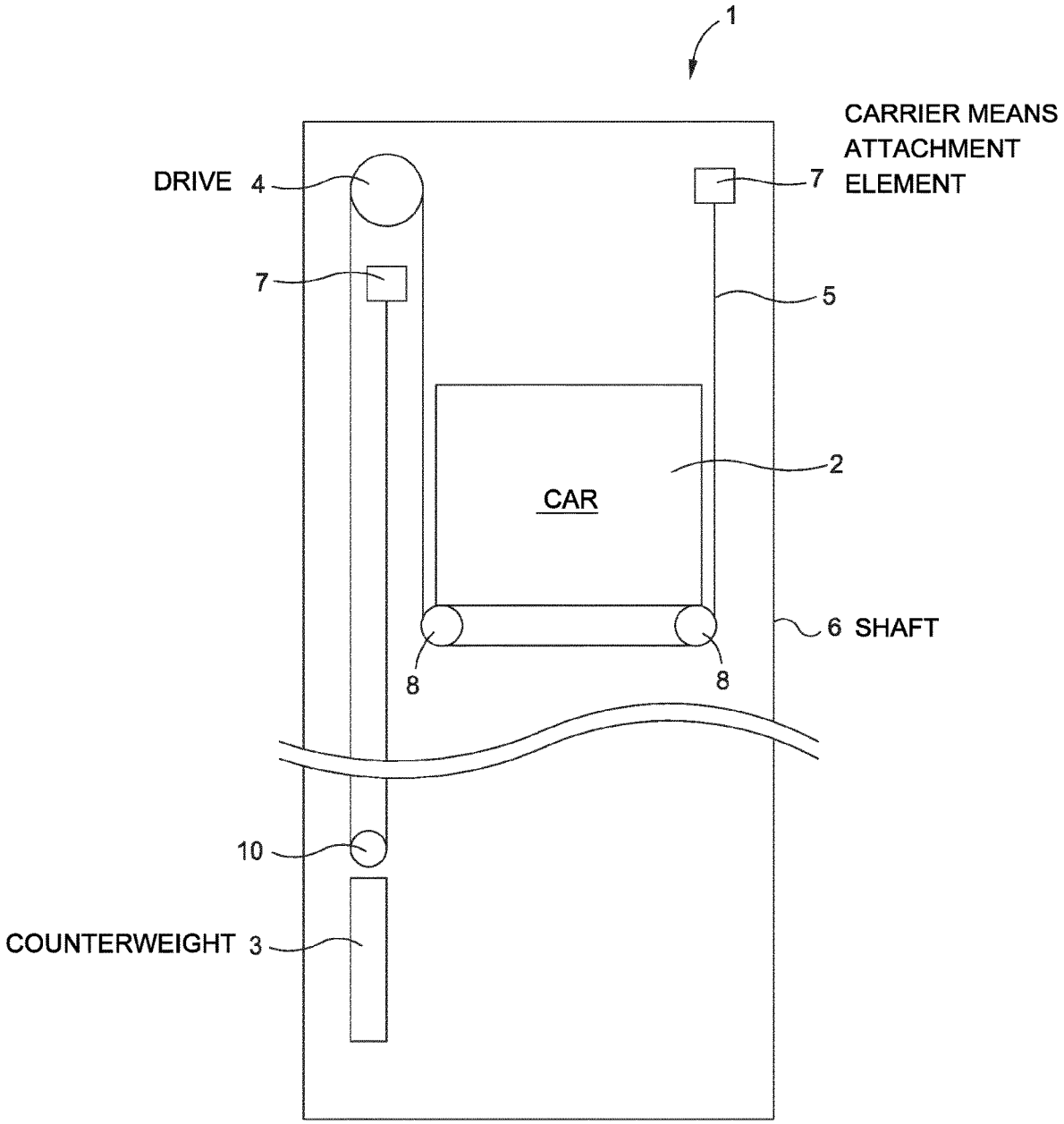
FIG. 1 is a schematic diagram of an exemplary elevator system.

In FIG. 1, an exemplary embodiment of an elevator system 1 is shown. The elevator system 1 comprises a car 2, a counterweight 3, a drive 4, and a belt-type suspension means or carrier means 5. The belt-type suspension means 5 is fixed in the elevator system 1 by a first carrier means attachment element 7, guided over a counterweight deflection roller 10, guided over a drive pulley of the drive 4, guided over two car deflection rollers 8, and again attached in the elevator system 1 by a second carrier means attachment element 7.

In this exemplary embodiment, the elevator system 1 is arranged in a shaft 6. In an alternative embodiment (not shown), the elevator system is not arranged in a shaft, but rather, for instance, on an exterior wall of a building.

The exemplary elevator system 1 in FIG. 1 comprises a counterweight 3. In an alternative embodiment (not shown), the elevator system does not include a counterweight. In addition, numerous other embodiments of an elevator system are possible.

Figure 2:
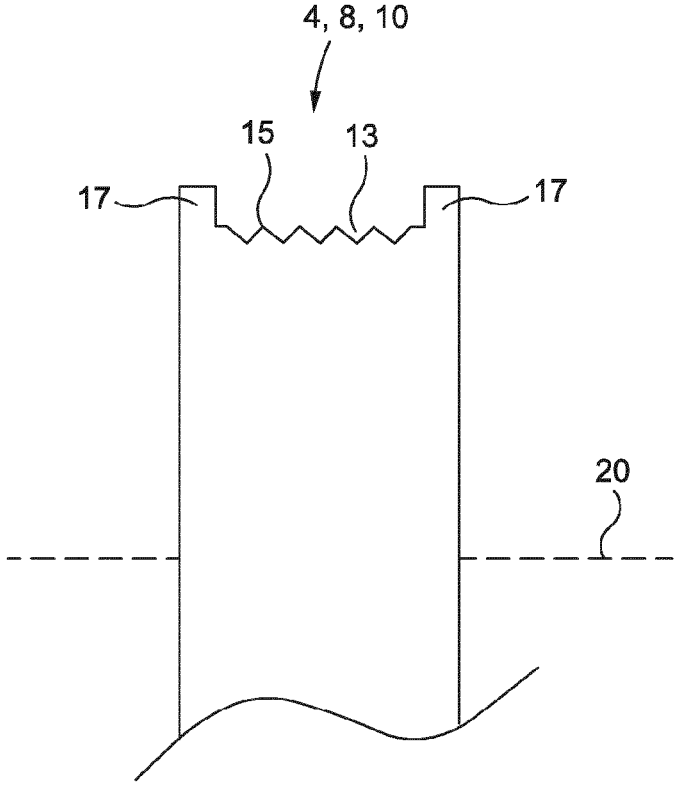
FIG. 2 is a schematic diagram of an exemplary roller.

In FIG. 2, an exemplary embodiment of a roller 4, 8, 10 is illustrated. This roller 4, 8, 10 can be used as a driver roller or as a car deflection roller or as a counterweight deflection roller in the elevator system. In the shown embodiment, roller 4, 8, 10 has two retaining elements 17. Retaining elements 17 are arranged in mirror symmetry with respect to each other. Each retaining element 17 is arranged on one side of the roller contact surface 15. In this exemplary embodiment, roller contact surface 15 comprises a plurality of longitudinal recesses 13. Roller 4, 8, 10 has at least as many longitudinal recesses 13 as the belt-type carrier means has longitudinal elevations. Roller 4, 8, 10 is arranged rotatably mounted around an axis of rotation 20.

Figure 3A:
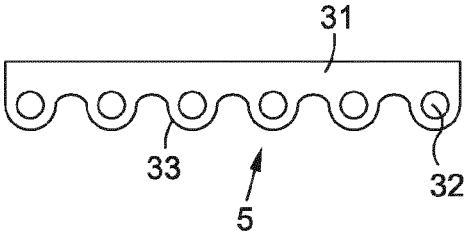
FIG. 3A is a schematic diagram of an exemplary belt-type carrier means.
Figure 3B:
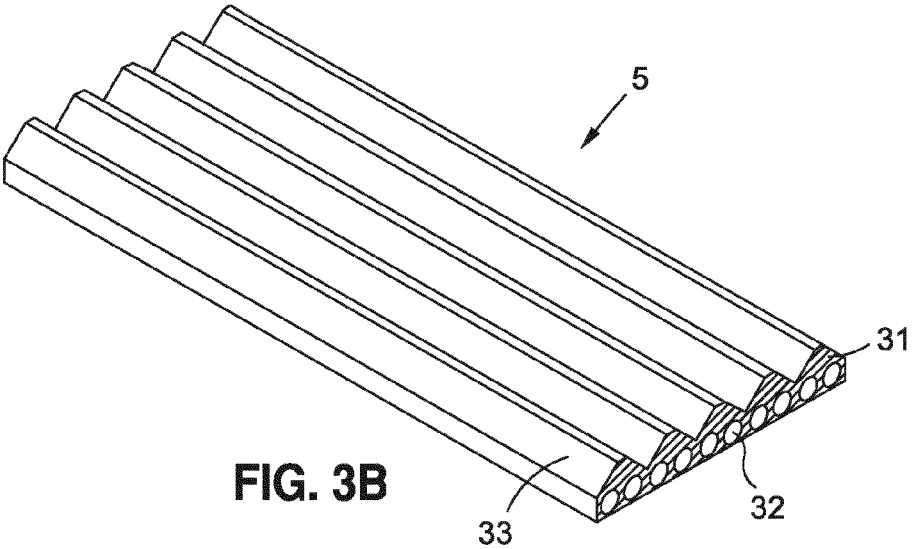
FIG. 3B is a schematic diagram of an exemplary belt-type carrier means.

Roller contact surface 15 of roller 4, 8, 10 from the exemplary embodiment in FIG. 2 is designed so that it can work together with a belt-type carrier means 5 according to FIG. 3B. Belt-type carrier means 5 in the exemplary embodiment according to FIG. 3B comprises a plurality of longitudinal elevations 33 in the form of V-ribs. Theses V-ribs are dimensioned so that they can engage complementarily into longitudinal recesses 13 of contact surface 15 of the roller according to FIG. 2. Belt-type carrier means 5 in FIG. 3B comprises a plurality of tension members 32 and a sheath 31 arranged around the tension members. In this arrangement, tension members 32 are arranged on a common level. Longitudinal elevations 33 are thus raised above this common level of tension members 32.

In FIG. 3A, an alternative belt-type carrier means 5 is illustrated by way of example. In contrast to the belt-type carrier means according to FIG. 3B, longitudinal elevations 33 in this exemplary embodiment are designed as elevations having a semicircular cross-section. Here, tension members 32 are at least partly arranged in these longitudinal elevations 33. Sheath 31 encloses all tension members 32 and thus connects tension members 32 into a common belt-type carrier means 5. Not shown is a roller to work with belt-type carrier means 5 according to the exemplary embodiment in FIG. 3A. Instead of v-shaped longitudinal recesses 13, as are shown in FIG. 2, such a roller would have longitudinal recesses with a semicircular cross-section.

In addition to belt-type carrier means shown by way of example in FIGS. 3A and 3B, a whole array of additional belt-type carrier means 5 having longitudinal elevations is possible. Clearly, a different embodiment is also possible in terms of the number of tension members as well as a design of the sheath shape. The tension members can additionally be arranged in different ways in the sheath. For example, a plurality of tension means can be arranged per longitudinal elevation or there can be exactly one tension means provided per longitudinal elevation. The arrangement of longitudinal elevations can also be chosen independently of the arrangement of tension members.

Figure 4:
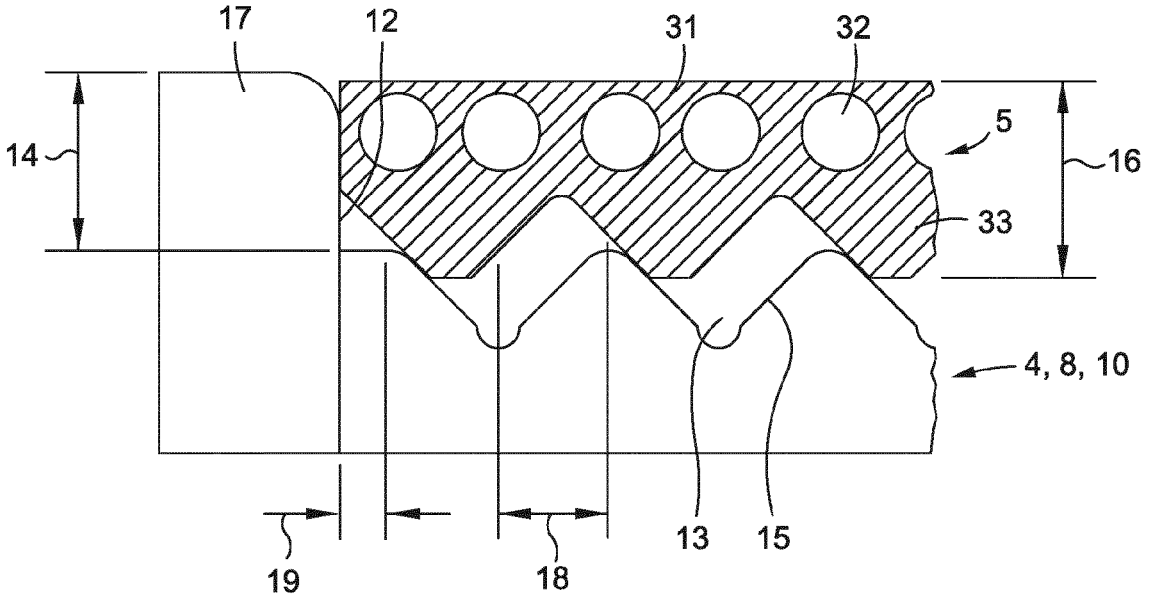
FIG. 4 is a schematic diagram of an exemplary belt-type carrier means on an exemplary roller.

In FIG. 4, a section of an exemplary roller 4, 8, 10 is shown, as well as a section of a belt-type carrier means 5 that works with it. Here, belt-type carrier means 5 has thus partly climbed out of longitudinal recesses 13 and is prevented from additional lateral upward movement by retaining element 17. Due to this limitation of movement, which is ensured by retaining element 17, belt-type carrier means 5 is prevented from further lateral displacement and is again guided back into its intended position on roller 4, 8, 10.

A distance 19 between an outermost longitudinal recess 13 and retaining element 17 is thus designed as less than half of the width of a longitudinal recess 18 of roller contact surface 15. This ensures that belt-type carrier means 5 cannot climb completely out of longitudinal recesses 13. Depending upon the embodiment of belt-type carrier means 5, distance 19 can be chosen smaller or larger. However, distance 19 selected should be at least large enough that a guide surface 12 of retaining element 17 does not hinder belt-type carrier means 5 in its movement over roller 4, 8, 10 during the normal operation of the elevator system.

Retaining element 17 in this exemplary embodiment is essentially dimensioned in such a way that belt-type carrier means 5 in its laterally upward movement cannot protrude beyond retaining element 17. Retaining element height 14 is thus about as high as a carrier means height 16. Retaining element height 14 can be selected as a function of distance 19 and the design of belt-type carrier means 5 so that belt-type carrier means 5 can at no time surpass retaining element 17. In this exemplary embodiment, an edge of retaining element 17 is also rounded off, so that the belt-type carrier means incurs no damage in the case of possible contact from this edge.

Figure 5:
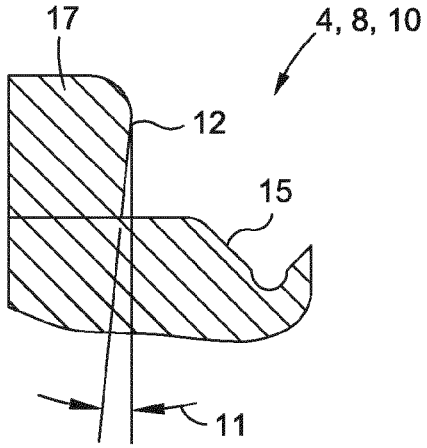
FIG. 5 is a schematic diagram of an exemplary retaining element.

In FIG. 5, a section of an exemplary embodiment of roller 4, 8, 10 is shown. In this arrangement, guide surface 12 of retaining element 17 has an inclined design. Guide surface 12 is thus inclined at an angle 11 to a line perpendicular to the axis of rotation of roller 4, 8, 10. In this exemplary embodiment, angle 11 is about 5°. This inclination of guide surface 12 makes it possible for the laterally moving belt-type carrier means to contact guide surface 12 only tangentially, so that the least possible abrasion of the belt-type carrier means occurs. In addition, the inclination of guide surface 12 causes the belt-type carrier means to be guided back down into longitudinal recesses 13. Also in this exemplary embodiment, an edge of retaining element 17 is rounded off in order to prevent a possible damage of the belt-type carrier means.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator system in which a belt-type carrier means is guided over a roller, wherein longitudinal elevations of the belt-type carrier means engage into longitudinal recesses of a contact surface of the roller, comprising:

the roller having at least one retaining element arranged laterally with respect to the longitudinal recesses of the roller contact surface, where the retaining element has a guide surface that is inclined by an angle relative to a line perpendicular to an axis of rotation of the roller, and the guide surface is inclined toward the belt-type carrier means as the guide surface extends away from the axis of rotation;

wherein a distance between an outer one of the longitudinal recesses and the at least one retaining element is less than half a width of the outer longitudinal recess of the roller contact surface; and wherein an edge of the at least one retaining element exposed in a direction of the roller contact surface is rounded, the edge being an outermost edge of the retaining element relative to the axis of rotation of the roller.

2. The elevator system according to claim 1 wherein the distance between the outer longitudinal recess and the at least one retaining element is less than 80% of half the width of the outer longitudinal recess.

3. The elevator system according to claim 1 wherein a height of the carrier means is approximately equal to a height of the at least one retaining element.

4. The elevator system according to claim 1 wherein the angle is between 3° and 7°.

5. The elevator system according to claim 1 wherein the at least one retaining element and another retaining element are arranged on opposite sides of the roller contact surface.

6. The elevator system according to claim 1 wherein the roller is a drive roller and wherein the roller contact surface is a traction surface.

7. The elevator system according to claim 1 wherein the roller is a car deflection roller or a counterweight deflection roller.

8. The elevator system according to claim 1 wherein the longitudinal elevations of the belt-type carrier means are V-ribs and wherein the longitudinal recesses of the roller contact surface are V-grooves.

9. The elevator system according to claim 1 wherein the longitudinal elevations of the belt-type carrier means have a semi-circular cross-section and wherein the longitudinal recesses of the roller contact surface have a semi-circular cross-section.

10. The elevator system according to claim 1 wherein a number of the longitudinal elevations of the belt-type carrier means is the same as a number of the longitudinal recesses of the roller contact surface.

11. The elevator system according to claim 1 wherein the roller and the at least one retaining element are formed as a single piece.

12. The elevator system according to claim 1 wherein the distance between the outer longitudinal recess and the at least one retaining element is less than 20% of half the width of the outer longitudinal recess.

13. The elevator system according to claim 1 wherein the angle is between 0° and 15°.

14. An elevator system comprising:

a belt-type carrier means supporting at least one of a car and a counterweight;

a roller over which the carrier means is guided, wherein longitudinal elevations of the carrier means engage into longitudinal recesses of a contact surface of the roller;

the roller having at least one retaining element arranged laterally with respect to the longitudinal recesses of the roller contact surface, where the retaining element has a guide surface that is inclined by an angle relative to a line perpendicular to an axis of rotation of the roller, and the guide surface is inclined toward the belt-type carrier means as the guide surface extends away from the axis of rotation; and wherein a distance between an outer one of the longitudinal recesses and the at least one retaining element is less than half a width of the outer longitudinal recess of the roller contact surface.

15. An elevator system in which a belt-type carrier means is guided over a roller, wherein longitudinal elevations of the belt-type carrier means engage into longitudinal recesses of a contact surface of the roller, comprising:

the roller having at least one retaining element arranged laterally with respect to the longitudinal recesses of the roller contact surface;

wherein a distance between an outer one of the longitudinal recesses and the at least one retaining element is less than half a width of the outer longitudinal recess of the roller contact surface;

wherein the at least one retaining element has a guide surface that is inclined by an angle relative to a line perpendicular to an axis of rotation of the roller; and wherein the guide surface is inclined toward the belt-type carrier means as the guide surface extends away from the axis of rotation.

16. The elevator system according to claim 15 wherein an edge of the at least one retaining element exposed in a direction of the roller contact surface is rounded, the edge being an outermost edge of the retaining element relative to the axis of rotation of the roller.

* * * * *